US006068151A

United States Patent [19]

Recendez M.

[11] Patent Number: 6,068,151

[45] Date of Patent: May 30, 2000

[54] TAMPER-INDICATING PLASTIC CLOSURE HAVING PILFER BAND

[75] Inventor: Luis G. Recendez M., Monterrey, Mexico

[73] Assignee: Fabricas Monterrey, S.A. de C.V., Monterrey, Mexico

[21] Appl. No.: 09/127,896

[22] Filed: Aug. 3, 1998

[51] Int. Cl.[7] ..... B65D 41/34

[52] U.S. Cl. ..... 215/252; 215/256

[58] Field of Search ..... 215/252, 250, 215/253, 258, 316, 329, 208, 214, 223, 256, 217, 254; 220/265, 266, 276

[56] References Cited

U.S. PATENT DOCUMENTS

| | | | |
|---|---|---|---|
| 3,329,295 | 7/1967 | Fields . | |
| 3,601,273 | 8/1971 | Kutcher . | |
| 4,418,828 | 12/1983 | Wilde et al. . | |
| 4,666,053 | 5/1987 | Corcoran et al. . | |
| 5,257,705 | 11/1993 | de Santana . | |
| 5,590,799 | 1/1997 | King | 215/252 |
| 5,603,422 | 2/1997 | Herrmann | 215/252 |
| 5,657,889 | 8/1997 | Guglielmini | 215/252 |
| 5,660,289 | 8/1997 | Spatz et al. . | |
| 5,715,959 | 2/1998 | Pfefferkorn et al. | 215/252 |
| 5,779,076 | 7/1998 | Kano | 215/252 |

*Primary Examiner*—Stephen Castellano
*Assistant Examiner*—Niki M. Eloshway
*Attorney, Agent, or Firm*—Oblon, Spivak, McClelland, Maier & Neustadt, P.C.

[57] ABSTRACT

A tamper-indicating plastic closure for a container includes a closure part and a pilfer band connected to the closure part at a frangible connection. A plurality of circumferentially spaced recesses are molded into the pilfer band adjacent the bottom edge of the pilfer band. A vertical break line is cut into the pilfer band, but terminates above the bottom edge of the pilfer band. Preferably, it terminates above the recess.

12 Claims, 2 Drawing Sheets

TAMPER-INDICATING PLASTIC CLOSURE HAVING PILFER BAND

BACKGROUND OF THE INVENTION

1. Field of the Invention

The present invention relates generally to tamper-indicating closures for containers, and more particularly to a tamper-evident plastic closure including a pilfer band having a vertical weakened region formed by a vertical line of reduced thickness which is formed by cutting or scoring.

2. Description of the Related Art

Tamper-indicating or tamper-evident container closures are well-known. For example, copending U.S. patent application Ser. No. 09/016,266, filed on Jan. 30, 1998, which is hereby incorporated by reference in its entirety, discloses tamper evident plastic closures for use in connection with bottles or like containers having a threaded neck and a locking ring. The tamper evident function is there provided by a pilfer band which is initially attached to the closure cap via a circumferential score line, but which breaks or separates from the closure cap and remains on the bottle when the closure cap is unscrewed or otherwise removed from the bottle for the first time. The pilfer band includes tabs or projections which engage the threads or locking ring of the bottle so as to resist the removal of the pilfer band.

It is also known to provide the pilfer band with a vertical line of reduced thickness which may be molded or cut into the plastic closure, hereinafter referred to as a vertical break line. The presence of the vertical break line results in a preferential rupture of the pilfer band at the vertical break line due to hoop stresses when the closure cap is first removed from the bottle, so that the pilfer band breaks and does not fully separate from the closure cap when the closure cap is first removed from the bottle. This is shown in U.S. Pat. Nos. 5,257,705; 3,329,295; 3,601,273; 4,418,828; 5,660,289 and 4,666,053. The pilfer band therefore remains with the closure cap, which is desirable for use with returnable bottles.

As a practical matter, it has proven difficult to produce such closure caps on a commercial basis such that the vertical break lines will reliably rupture during removal of the cap from the bottle. In the case of cut or scored vertical break lines, this is due in part to the difficulty of accurately controlling the depth of cut of the vertical break line adjacent the bottom edge of the pilfer band.

SUMMARY OF THE INVENTION

It is an object of the present invention to overcome the aforementioned shortcomings of the conventional tamper indicating plastic closures.

It is a further object of the invention to provide a tamper indicating plastic closure having a pilfer band having a cut vertical break line, and which will reliably rupture during removal of the closure cap from the bottle.

According to one aspect of the invention, the above and other objects are achieved by a tamper-indicating plastic closure for a container having an annular locking ring, in which the closure comprises a closure part and a pilfer band connected to the closure part at a frangible connection. A plurality of circumferentially spaced recesses are molded into the pilfer band adjacent the bottom edge of the pilfer band. A vertical break line is cut into the pilfer band, but terminates above the bottom edge of the pilfer band. Preferably, it terminates above the recess.

The molded recesses provide the rupture function at the bottom edge of the pilfer band. It is therefore unnecessary to cut the vertical break line as far as the bottom edge. The recesses can be molded with better control of their rupture strength than can the vertical break line at the bottom edge, and so a more reliable rupture of the pilfer band can be guaranteed.

It may be understood that the vertical break line need not extend exactly vertically so long as it extends generally vertically, and so the phrase "vertical break line" also covers break lines which are slightly angled from the vertical. It may also be understood that the recesses could be formed at the inner or outer surfaces of the pilfer band, but that the inner surface is preferred for cosmetic reasons.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The closure according to the invention is formed of a conventional plastic and can be made by various conventional injection molding or compression molding techniques. It includes a closure part 10 and a pilfer band 20. The closure part 10 is conventional and may substantially correspond to that described in the aforementioned U.S. patents or copending application Ser. No. 09/016,266. It includes a skirt 15 having threads 11 which cooperate with threads on the exterior of the mouth portion of a bottle (not shown) to retain the closure part on the bottle and seal the mouth of the bottle. The pilfer band 20 is also conventional and may substantially correspond to that shown in the aforementioned U.S. patents, except as noted below.

Figure 1:
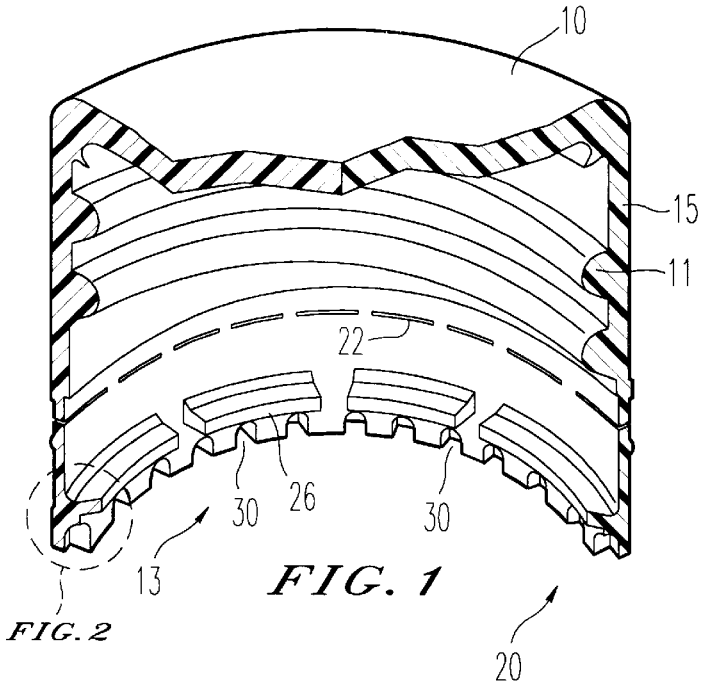
FIG. 1 is a cut away view of a quadrant of a tamper indicating plastic closure according to the invention.
Figure 2:
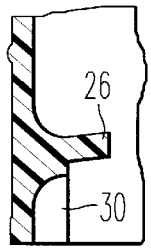
FIG. 2 is a detail of the circled section in FIG. 1.
Figure 3:
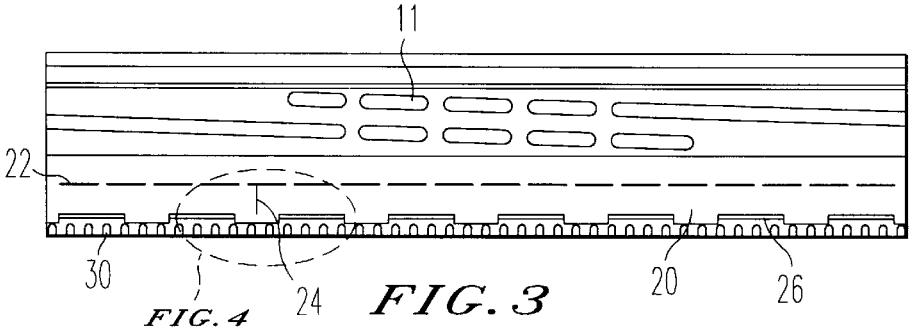
FIG. 3 is a developed view of the skirt and pilfer band of the closure of FIG. 1.
Figure 4:
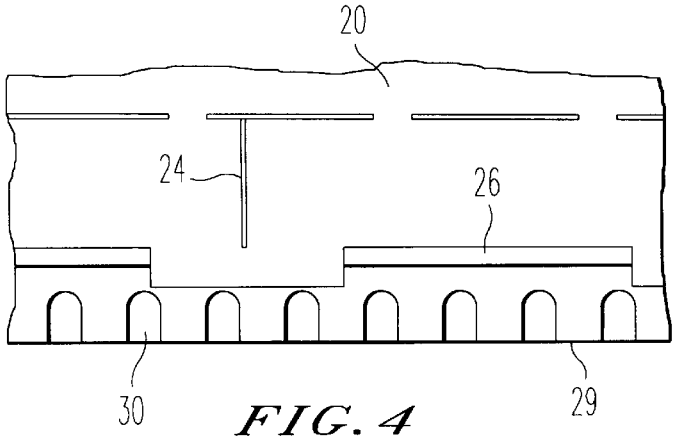
FIG. 4 is detail of FIG. 3.

The pilfer band is connected to the closure part 10 by a conventional frangible connection 22 in the form of a score line which may be made in a conventional manner. Adopting the frame of reference, to be used throughout the remainder of this description, that closure cap shown in FIG. 1 is positioned with its opening 13 facing downward, the frangible connection 22 connects the bottom edge of the skirt 15 with the top edge of the closure 20.

A plurality of projections or tabs 26 are formed on the inner peripheral surface of the pilfer band. The tabs 26 are preferably integrally molded with the pilfer band 20 and are intended to engage the underside of the locking ring to cause a separation at the frangible connection 22 which prevents the pilfer band 20 from being removed from the bottle, or to cause the pilfer band to break at the vertical break line 24, which is described in further detail below, when the closure part is first removed (e.g., unscrewed) from the bottle.

The vertical break line 24 is provided in order that the pilfer band will preferentially break due to hoop stresses during the first removal of the closure part from a bottle, so that the pilfer band 20 does not fully separate from the closure part 10 at the frangible connection 22. This feature is desirable for returnable bottles. The vertical break line 24 may be formed by cutting or scoring in a conventional manner. It extends downward from the score line 22 but terminates above the lower edge 29 of the pilfer band.

The closure cap 10 and the pilfer band 20 are normally molded together. A circumferentially spaced series of recesses 30 are molded into the inner surface of the pilfer band between the tabs 26 and the lower edge 29 of the pilfer band. They are illustrated as all being equally spaced but may instead be unequally spaced. The recesses are illustrated as being arch shaped, but may have other shapes as well. They extend upward from the lower edge 29 to a height which is preferably at or below the bottom 24A of the vertical break line.

The recesses 30 should have such a size and depth that they are able to form an extension of the vertical break line 24. That is, when the pilfer band 20 ruptures at the vertical break line 24 due to hoop stresses during the initial removal of the closure cap from a bottle, the stresses causing the rupture at the vertical break line should also be sufficient to rupture the pilfer band at the recess 30 closest to the bottom 24A of the vertical break line 24.

Thus the molded recesses 30 provide the rupture function at the bottom edge 29 of the pilfer band 20. It is therefore unnecessary to cut the vertical break line 24 as far as the bottom edge 29. The recesses 30 can be molded with better control of their rupture strength than can the vertical break line 24 at the bottom edge 29, and so a more reliable rupture of the pilfer band can be guaranteed.

Figure 7:
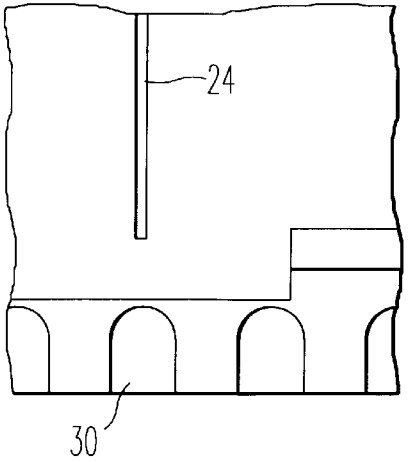
FIGS. 5–7 are details showing three possible variants of the pilfer band.
Figure 6:
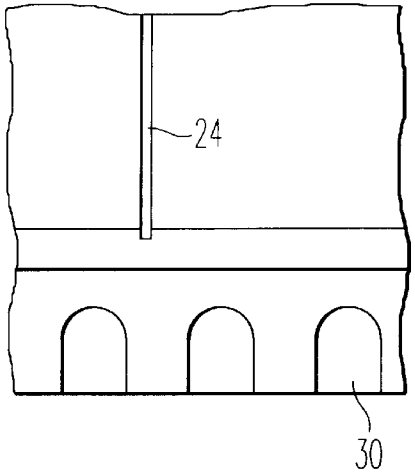
Figure 5:
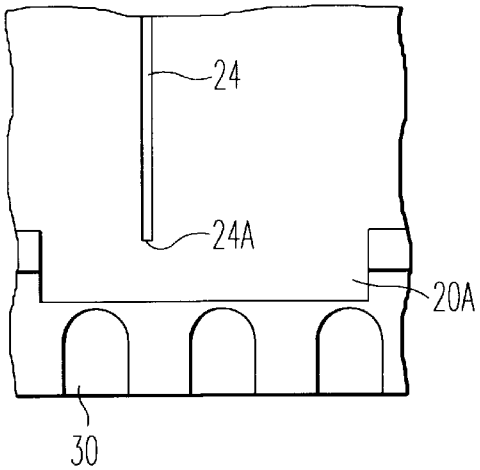

It may be noted that the rupture strength of the pilfer band can be fine tuned by selecting the circumferential position of the vertical break line 24 on the pilfer band and relative to the closest recesses 30. Thus, in FIG. 5 the vertical break line 24 is formed at a thickened bridgelike part 20A of the pilfer band 20 and equidistant between two recesses 30. Therefore, a relatively long portion of thick plastic material is present between bottom 24A of vertical break line 24 and the nearest recess 30, and so the rupture strength in this region is high. On the other hand, in FIG. 6 the vertical break line 24 is not formed at the thickened bridgelike part of the pilfer band 20, but is still equidistant between two recesses 30. Therefore, a relatively long portion of thinner plastic material is present between bottom 24A of vertical break line 24 and the nearest recess 30, and so the rupture strength in this region is low. Finally, in FIG. 7 the vertical break line 24 is formed at the thickened bridgelike part 20A of the pilfer band 20 but is directly above a recesses 30. Therefore, a relatively short portion of thick plastic material is present between bottom 24A of vertical break line 24 and the nearest recess 30, and so the rupture strength in this region is between the cases of FIGS. 5 and 6.

Obviously, additional modifications and variations of the present invention are possible in light of the above teachings. It is therefore to be understood that within the scope of the appended claims, the invention may be practiced otherwise than as specifically described herein.

What is claimed is:

1. A molded tamper-indicating plastic closure for a container having an annular locking ring, comprising:

a closure part;

a pilfer band having an upper edge molded to the closure part at a frangible connection;

a vertical break line cut into the pilfer band, the vertical break line extending from adjacent the frangible connection for causing the pilfer band to rupture during the removal of the closure part from a bottle and having a bottom terminating above a bottom edge of the pilfer band; and a plurality of circumferentially spaced recesses molded into the inner surface of the pilfer band at the bottom edge of the pilfer band, wherein the bottom edge of the vertical break line terminates above the recesses.

2. The tamper-indicating plastic closure of claim 1, wherein said recesses are in the form of arches.

3. The tamper-indicating plastic closure of claim 1, wherein said recesses are sized and shaped such that when the pilfer band ruptures at the vertical break line during the removal of the closure part from a bottle, the pilfer band also ruptures at the recess closest to the bottom of the vertical break line.

4. The tamper-indicating plastic closure of claim 1, wherein the vertical break line is circumferentially aligned with one of the recesses.

5. The tamper-indicating plastic closure of claim 1, wherein the vertical break line is not circumferentially aligned with any of the recesses.

6. The tamper-indicating plastic closure of claim 1, wherein the plurality of circumferentially spaced recesses are molded into the inner surface of the pilfer band.

7. A molded tamper-indicating plastic closure for a container having an annular locking ring, comprising:

a closure part;

a pilfer band having an upper edge molded to the closure part at a frangible connection;

a vertical break line cut into the pilfer band, the vertical break line extending from adjacent the frangible connection for causing the pilfer band to rupture during the removal of the closure part from a bottle and having a bottom terminating above a bottom edge of the pilfer band; and a plurality of circumferentially spaced recesses molded into the inner surface of the pilfer band at the bottom edge of the pilfer band, further comprising a plurality of circumferentially spaced tabs positioned above the recesses and having lengths extending generally inwardly from an inner surface of said pilfer band.

8. The tamper-indicating plastic closure of claim 7, wherein said recesses are in the form of arches.

9. The tamper-indicating plastic closure of claim 7, wherein the vertical break line is circumferentially aligned with one of the recesses.

10. The tamper-indicating plastic closure of claim 7, wherein the plurality of circumferentially spaced recesses are molded into the inner surface of the pilfer band.

11. A molded tamper-indicating plastic closure for a container having an annular locking ring, comprising:

a closure part;

a pilfer band having an upper edge molded to the closure part at a frangible connection;

a vertical break line cut into the pilfer band, the vertical break line extending from adjacent the frangible connection for causing the pilfer band to rupture during the removal of the closure part from a bottle and having a bottom terminating above a bottom edge of the pilfer band; and a plurality of circumferentially spaced recesses molded into the inner surface of the pilfer band at the bottom edge of the pilfer band, further comprising a plurality of circumferentially spaced tabs having lengths extending generally inwardly from an inner surface of said pilfer band, wherein said recesses are sized and shaped such that when the pilfer band ruptures at the vertical break line during the removal of the closure part from a bottle, the pilfer band also ruptures at the recess closest to the bottom of the vertical break line.

12. A molded tamper-indicating plastic closure for a container having an annular locking ring, comprising:

a closure part;

a pilfer band having an upper edge molded to the closure part at a frangible connection;

a vertical break line cut into the pilfer band, the vertical break line extending from adjacent the frangible connection for causing the pilfer band to rupture during the removal of the closure part from a bottle and having a bottom terminating above a bottom edge of the pilfer band; and a plurality of circumferentially spaced recesses molded into the inner surface of the pilfer band at the bottom edge of the pilfer band, further comprising a plurality of circumferentially spaced tabs having lengths extending generally inwardly from an inner surface of said pilfer band, wherein the vertical break line is not circumferentially aligned with any of the recesses.

* * * * *